US005743048A

United States Patent [19]

Kim

[11] Patent Number: 5,743,048

[45] Date of Patent: Apr. 28, 1998

[54] SHIELD FOR DOOR-LOCKING DEVICE DISPOSED IN A FOAM-FILLED REFRIGERATOR DOOR

[75] Inventor: Chang Yong Kim, Kyunggi-do, Rep. of Korea

[73] Assignee: Samsung Electronics Co., Ltd., Suwon, Rep. of Korea

[21] Appl. No.: 694,272

[22] Filed: Aug. 8, 1996

[30] Foreign Application Priority Data

Nov. 30, 1995 [KR] Rep. of Korea ..... 95-37586

[51] Int. Cl.[6] ..... E06B 3/00

[52] U.S. Cl. ..... 49/503; 292/DIG. 71; 52/742.11

[58] Field of Search ..... 292/DIG. 71; 49/503, 49/167, 501; 70/54, 56, 55; 52/742.11

[56] References Cited

U.S. PATENT DOCUMENTS

| | | | |
|---|---|---|---|
| 2,069,088 | 1/1937 | Geske et al. | 292/DIG. 71 |
| 2,784,022 | 3/1957 | North et al. | 292/DIG. 71 |
| 2,877,041 | 3/1959 | Foley | 292/DIG. 71 |
| 2,924,861 | 2/1960 | Viets | 49/503 |
| 2,966,864 | 1/1961 | Weaver | 292/DIG. 71 |
| 3,122,796 | 3/1964 | Wooley | 292/DIG. 71 |
| 4,118,895 | 10/1978 | Governale | 49/503 |
| 4,218,848 | 8/1980 | Nelson | 49/503 |
| 4,530,532 | 7/1985 | Fujiya | 292/DIG. 71 |
| 4,561,212 | 12/1985 | Ullman, Jr. | 49/503 |

FOREIGN PATENT DOCUMENTS

| | | | |
|---|---|---|---|
| 2253137 | 6/1975 | France | 49/503 |

*Primary Examiner*—Darnell M. Boucher

*Attorney, Agent, or Firm*—Burns, Doane, Swecker & Mathis, L.L.P.

[57] ABSTRACT

A refrigerator door includes walls forming therebetween a space that is filled with foam insulation. A door-locking device is mounted in the space and is covered by a shield which shields the door-locking device from the foam when the foam is being injected into the space. The shield includes a mounting edge facing one of the walls and forming a slight gap therewith into which the foam can travel. The edge includes a channel which forms an enlargement in the gap that ensures that the incoming foam hardens before reaching the interior of the shield and damaging the door-locking device.

2 Claims, 2 Drawing Sheets

SHIELD FOR DOOR-LOCKING DEVICE DISPOSED IN A FOAM-FILLED REFRIGERATOR DOOR

BACKGROUND OF THE INVENTION

1. Field of the Invention

The present invention relates in general to a shield for a locking device in refrigerator doors.

2. Description of the Prior Art

Particularly in summer days, children open the door of a refrigerator excessively often to enjoy frozen or cold foodstuffs or drink cooling beverages thereby causing the refrigerator to repeatedly lose cool air and waste electric power. When the refrigerator repeatedly loses cool air through the opened door, the temperature inside the refrigerator rises and thereby fails to keep food in cold storage. In addition, eating or drinking too many frozen or cold foodstuffs and cooling beverages may cause children to fall ill, such as in stomach trouble. In order to allow users to selectively lock the door of a refrigerator and thereby restrain children from opening the door without permission, refrigerators with door locking devices have been proposed and used in recent years. U.S. Pat. Nos. 5,265,921, 5,268,811 and 5,275,029 disclose door locking devices for refrigerators.

And, a shield which covers a door locking device for a refrigerator is described in Japanese laid-open utility model gazette SHO 48-30862.

FIGS. 1, 2A and 2B show a typical door locking device for refrigerators. As shown in the drawings, the door locking device 2 is installed in a gap between the outer casing 3 and the inner panel 4 in an upper portion of the door 1 of the refrigerating compartment. The users can selectively lock the door by using the locking device thereby restraining children from opening the door without permission.

As well known to those skilled in the art, the doors have been produced by filling the space between the outer casing 3 and the inner panel 4 with foam 5 after settling the door locking device 2 inside the outer casing 3. The foam 5 such as urethane foam is hardened when a predetermined time has elapsed after filling the space. The foam 5 acts as an insulator for thermally insulating the interior of the refrigerator from the atmosphere.

However, the foam 5 may undesirably infiltrate into the door locking device 2 while the foam is injected into the space between the casing 3 and the panel 4. When the foam 5 infiltrates into the locking device 2 and is hardened in the device 2, the locking device 2 can be neither operated nor removed from the outer casing 3 due to the hardened foam 5. In this case, the refrigerator door must be regrettably discarded even though the other parts of the refrigerator door except for the locking device are not damaged, thus wasting money.

In order to prevent the foam 5 from infiltrating into the locking device 2 while injecting the foam, a shield 6' which is mounted to the casing 3 and covers the locking device 2A as shown in FIGS. 2 and 2B has been proposed. However, the foam 5 still infiltrates inside the shield 6' through a gap G between the mounting edge **6*a*' of the shield 6' and the casing 3 and thereby still results in a bad effect on the locking device 2 as shown in FIG. 2B since the foam 5 under high pressure is injected into the gap between the casing 3 and the panel 4. Therefore, the shield 6' fails to completely prevent the foam 5 from having a bad effect on the door locking device 2**.

In an effort to prevent the foam 5 from Infiltrating inside the shield 6' through the gap G, a cushion such as a sponge may be mounted to the mounting edge **6*a*' of shield 6' to block the gap G. However, the cushion is easily cut or damaged by even a weak force, so that there may develop a discontinuity in the blocking side of the cushion which thus fails to completely block the gap G edge. In this regard, the cushion must be carefully mounted to the gap between the shield's edge 6*a*' and the casing 3**, thus causing a difficulty while mounting the cushion and reducing the manufacturing productivity.

SUMMARY OF THE INVENTION

It is, therefore, an object of the present invention to provide a shield for a door locking device in refrigerators which effectively prevents the foam from infiltrating inside the shield without using any means additionally mounted to the shield for intercepting the foam, thereby completely isolating the door locking device from the foam and simplifying the process of producing the door, and improving the manufacturing productivity.

In order to accomplish the above object, the present invention provides a door locking device shield mounted to the interior wall of the outer casing of a refrigerator door to cover a door locking device and prevent insulating foam from reaching the door locking device, wherein a mounting edge of the shield is shaped for sealing the interior of the shield and thereby preventing the foam from reaching the interior of the shield through the gap between the mounting edge of the shield and the outer casing.

In an embodiment of the present invention, the sealing means is a channel which is longitudinally formed on the mounting edge of the shield.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF A PREFERRED EMBODIMENT

Figure 1:
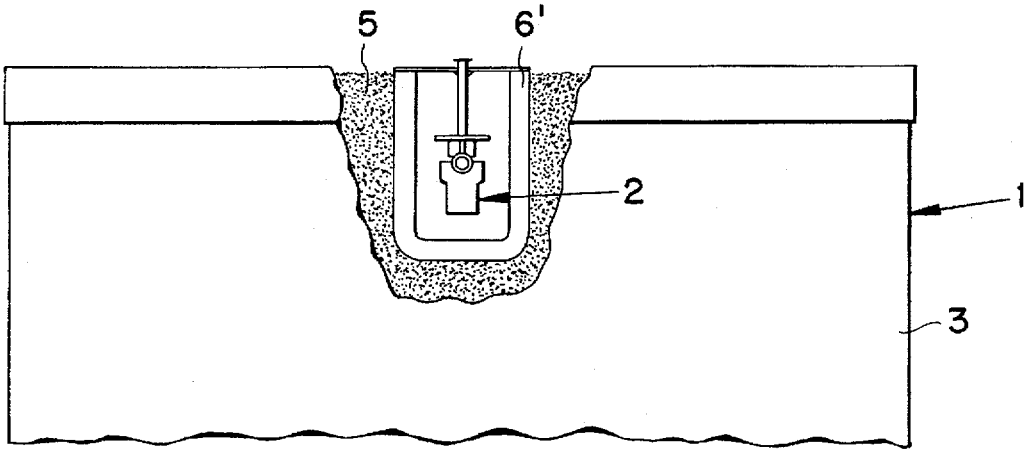
FIG. 1 PRIOR ART
FIG. 1 is a partially broken front view of the door of a refrigerator, showing a prior art shield for a door locking device of the refrigerator.
Figure 2A:
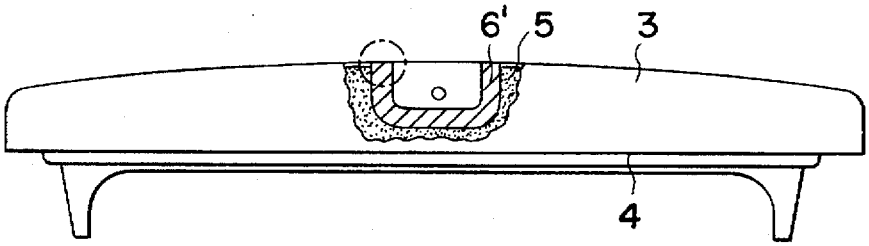
FIG. 2A PRIOR ART
FIG. 2A is a top view of FIG. 1.
Figure 2B:
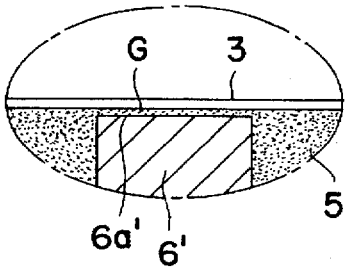
FIG. 2B PRIOR ART
FIG. 2B is an enlarged view of an encircled portion of FIG. 2A.

Most of the elements of the preferred embodiment of this invention are common with those of the prior art embodiment of FIGS. 1 and 2. The common elements will thus carry the same reference numerals and description thereof is omitted.

Figure 3:
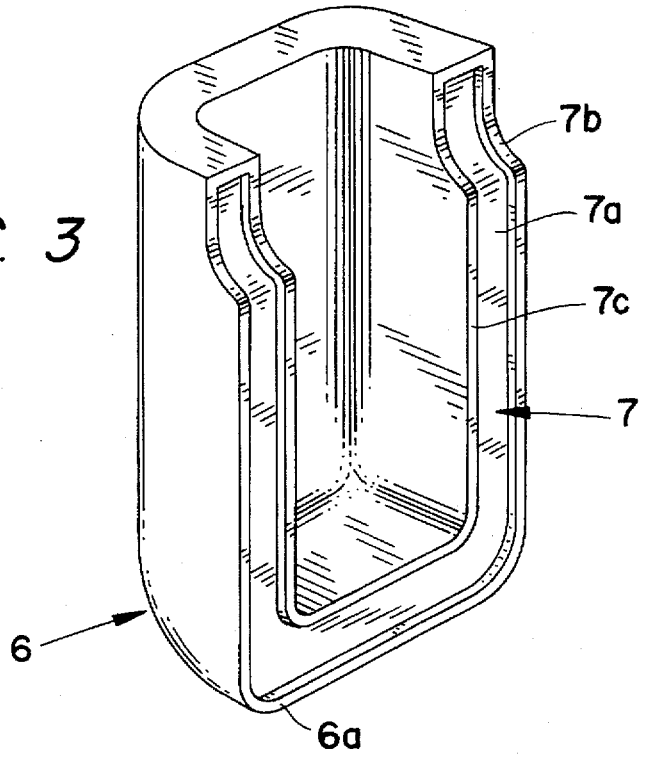
FIG. 3 is a perspective view showing the configuration of a shield for a door locking device in accordance with a preferred embodiment of the present invention.
Figure 4A:
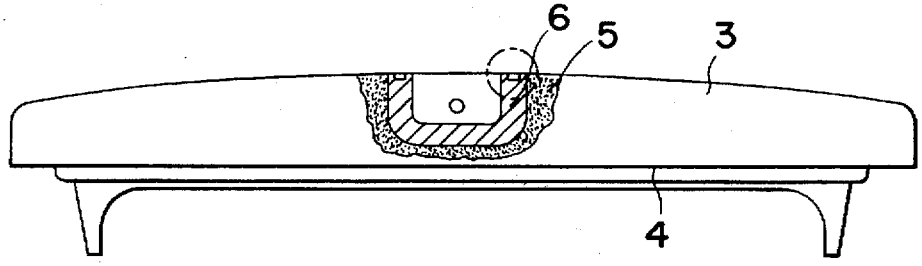
FIGS. 4A and 4B correspond to FIGS. 2A and 2B, respectively, but showing the operational effect of the shield of this invention.
Figure 4B:
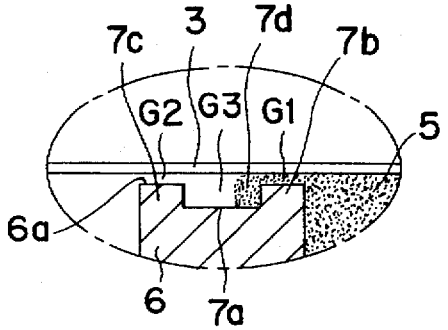

FIGS. 3, 4A and 4B show a shield for a refrigerator's door locking device in accordance with a preferred embodiment of the present invention. As shown in FIG. 4A, the shield 6 of this invention is mounted to the outer casing 3 of a door 1 in a way such that the shield 6 surrounds a door locking device 2 and prevents foam 5 from infiltrating into the device 2 while the foam 5 is being introduced in the gap between the outer casing 3 and the inner panel 4.

The shield 6 is provided with a sealing means 7 which effectively prevents the foam 5 from infiltrating inside the shield 6 through the gap between the casing 3 and the shield's edge 6*a* thus completely preventing the foam 5 from having a bad effect on the locking device 2.

As shown in FIG. 3, the sealing means 7 comprises a channel 7*a* which is longitudinally formed on the mounting edge 6*a* of the shield 6. The mounting edge 6*a* is brought into contact with the interior wall of the outer casing 3. Due to the channel 7*a*, the shield 6 has first and second mounting rails 7*b* and 7*c* longitudinally extending on opposite sides of the channel 7*a* respectively. A space 7*d* is defined between the two mounting rails 7*b* and 7*c*. The rails 7*b* and 7*c* form narrow inner and outer portions G1 and G2 of a gap between the edge 6*a* and the outer casing 3, and the space 7*d* forms a wider portion G3 of the gap.

The operational effect of the above shield 6 will be described in detail hereinbelow.

When the foam 5 under high pressure is injected into the gap between the outer casing 3 and the inner panel 4 of the door during the process of producing the door, the foam 5 is introduced into the space 7*d* of the channel 7*a* through the outer portion G1 of the gap. The foam 5 inside the space 7*d* in turn slowly travels toward the inner portion G2 of the gap.

The slowly traveling foam 5 inside the space 7*d* is hardened before it is able to completely fill the space 7*d*. The hardened foam 5 inside the space 7*d* restrains the foam from further flowing within the space 7*d* and into the inner portion G2 of the gap, thereby preventing the foam from being introduced into the shield 6. The shield 6 with the sealing means 7 thus completely prevents the foam 5 from being introduced to the door locking device 2.

In the above preferred embodiment, the channel 7*a* of the sealing means 7 has an angled U-shaped cross-section as shown in FIG. 4B. Of course, it should be understood that there may be employed various cross-sections of the channel such as a rounded U-shaped cross-section or V-shaped cross-section.

As described above, the present invention provides a structurally-improved shield for a door locking device in refrigerators. The shield effectively prevents injected foam from infiltrating inside the shield without using any means additionally mounted to the shield for intercepting the foam, thereby completely isolating the door locking device from the foam and simplifying the process of producing the door, and improving the manufacturing productivity.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

I claim:

1. A refrigerator door comprising:

a wall structure forming an interior space filled with injected foam insulation;

a door-locking device disposed within the space; and a U-shaped shield surrounding the door-locking device, the shield including an interior surface, an exterior surface and a mounting edge located between the interior surface and the exterior surface; said mounting edge facing the wall structure and the wall structure being spaced from the mounting edge to define a gap therebetween the gap extending from the interior surface of the shield to the space; the mounting edge having a shape to prevent the injected foam from reaching the interior surface of the shield and damaging the door-locking device;

said shape including a U-shaped channel, forming an enlargement in the gap; said foam being disposed in the gap between the space and the enlargement and in the enlargement, the foam terminating short of the interior surface of the shield.

2. The refrigerator door according to claim 1 wherein the mounting edge includes outer and inner rails disposed on respective sides of the channel and forming portions of the gap that are narrower than the enlargement of the channel.

* * * * *